US007182002B2

(12) United States Patent
Hu

(10) Patent No.: US 7,182,002 B2
(45) Date of Patent: Feb. 27, 2007

(54) SCREWDRIVER HANDLE STRUCTURE

(76) Inventor: Hung-ming Hu, No. 205-1, Tu Tzu Tou, Tu Tou Village, Kuan Tien Shiang, Tainan Hsien (TW)

( * ) Notice: Subject to any disclaimer, the term of this patent is extended or adjusted under 35 U.S.C. 154(b) by 8 days.

(21) Appl. No.: 11/088,733

(22) Filed: Mar. 25, 2005

(65) Prior Publication Data

US 2006/0213336 A1 Sep. 28, 2006

(51) Int. Cl.

| | |
|---|---|
| ***B25B 23/16*** | (2006.01) |
| ***B25G 1/08*** | (2006.01) |
| *B25B 23/00* | (2006.01) |
| *B25B 15/00* | (2006.01) |

(52) U.S. Cl. ..... 81/177.4; 81/490; 81/438; 7/165

(58) Field of Classification Search ..... 81/177.4, 81/490, 438, 439; 145/62, 63; 7/165, 167
See application file for complete search history.

(56) References Cited

U.S. PATENT DOCUMENTS

| | | | | |
|---|---|---|---|---|
| 685,678 | A * | 10/1901 | Fibrish | 74/127 |
| 2,337,514 | A * | 12/1943 | Wilcox | 408/132 |
| 4,434,828 | A * | 3/1984 | Trincia | 81/177.4 |
| 5,499,562 | A * | 3/1996 | Feng | 81/177.4 |
| 5,704,706 | A * | 1/1998 | Goldston et al. | 362/103 |
| 5,749,271 | A * | 5/1998 | Liu | 81/60 |
| 5,782,150 | A * | 7/1998 | Huang | 81/177.4 |
| 5,887,306 | A * | 3/1999 | Huang | 7/165 |
| 6,196,093 | B1 * | 3/2001 | Hu | 81/490 |
| 6,327,942 | B1 * | 12/2001 | Mariol et al. | 81/177.4 |
| 6,502,484 | B2 * | 1/2003 | Pao-Hsi | 81/439 |
| 6,601,483 | B2 * | 8/2003 | Wannop | 81/490 |
| 6,877,186 | B2 * | 4/2005 | Shiao | 16/111.1 |

* cited by examiner

*Primary Examiner*—Lee D. Wilson
*Assistant Examiner*—Alvin J. Grant
(74) *Attorney, Agent, or Firm*—Rosenberg, Klein & Lee

(57) ABSTRACT

A screwdriver handle structure includes a handle having a storage compartment. The compartment comprises a number recesses to store screw heads therein. The handle is provided with a locator having a trough to receive an engaging device therein. The handle further comprises sliding sections to secure a sliding cover thereon in order to store screw heads.

3 Claims, 4 Drawing Sheets

SCREWDRIVER HANDLE STRUCTURE

BACKGROUND OF THE INVENTION

1. Field of the Invention

This invention relates to a screwdriver handle structure, and more particularly to a handle having a compartment with a sliding cover to store screw heads in the compartment.

2. Description of the Prior Art

A conventional screwdriver bears only one head, which is not convenient to a user. Thus a screwdriver with exchangeable head was derived. The screw heads may be exchanged to different purposes, however, due to the compact sizes of the screw heads, they may be lost accidentally. Therefore, a screwdriver with a storage compartment in the handle was derived, as shown in FIG. 4, which comprises a front handle body A. A compartment A1 is formed in the front handle body A to receive a rear handle body A2 which comprises a number of recesses A3 to store screw heads B. This design adds a rear handle body in order to store screw heads B, which increases the cost and makes the handle heavier.

SUMMARY OF THE INVENTION

It is the primary objective of the present invention to provide a screwdriver handle structure, which comprises a compartment with a sliding cover to store screw heads therein.

It is a further objective of the present invention to provide a screwdriver handle structure, which modifies the original handle to add a storage compartment without adding any extra parts nor does it change the shape.

It is another objective of the present invention to provide a screwdriver handle structure, which is easy to operate and is cost-effectiveness.

DETAILED DESCRIPTION OF THE PREFERRED EMBODIMENT

Figure 1:
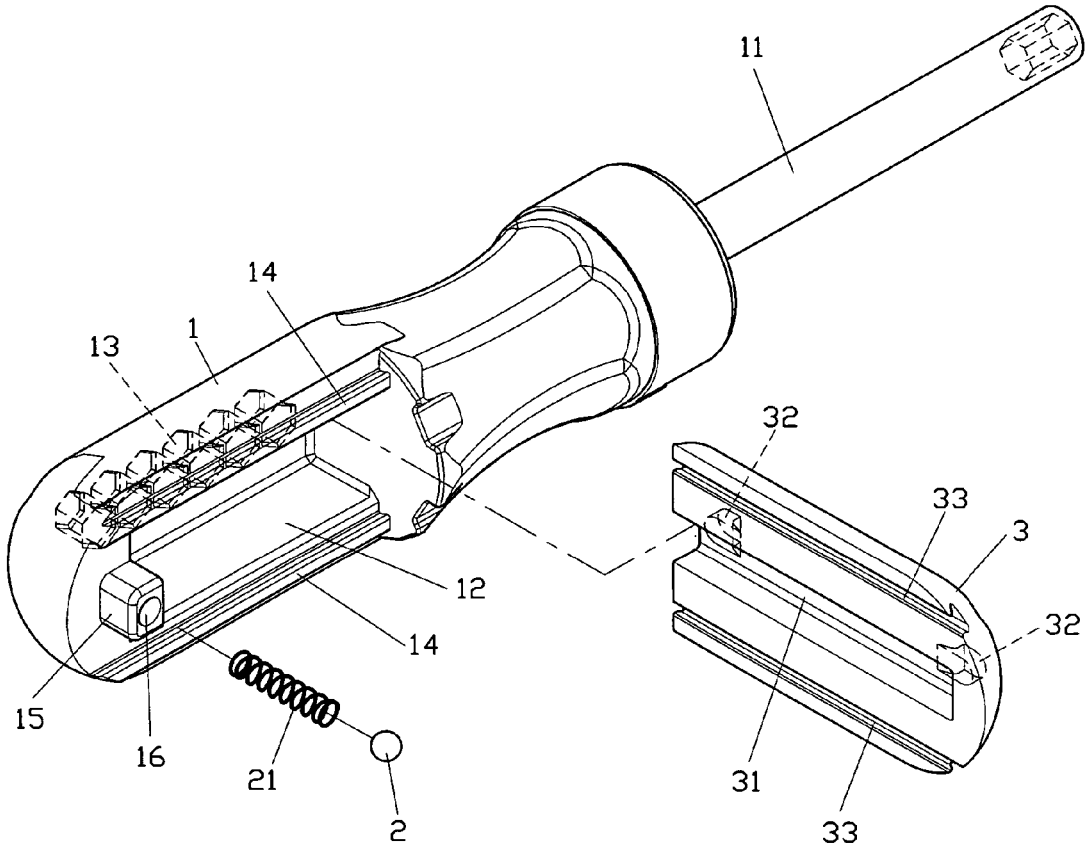
FIG. 1 is an exploded view of the present invention.

As shown in FIG. 1, the present invention comprises a handle 1, an engaging device 2, and a sliding cover 3.

The handle 1 comprises a sleeve 11 at the front end and a storage compartment 12 within the handle 1. The compartment 12 comprises a number of recesses 13 therein. A pair of sliding sections which can be sliding strips 14 are formed on respective sides of the compartment 12. A locator 15 having a trough 16 is formed on one end of the handle 1.

The engaging device 2 is placed in the trough 16. The engaging device 2 is a bead with an elastic element 21 seating underneath.

The sliding cover 3 comprises a sliding trough 31 on the inner edge with a pair of locating holes 32 at respective ends of the trough 31, and a pair of sliding sections which can be sliding channels 33 to be meshed with the sliding strips 14.

Figure 2:
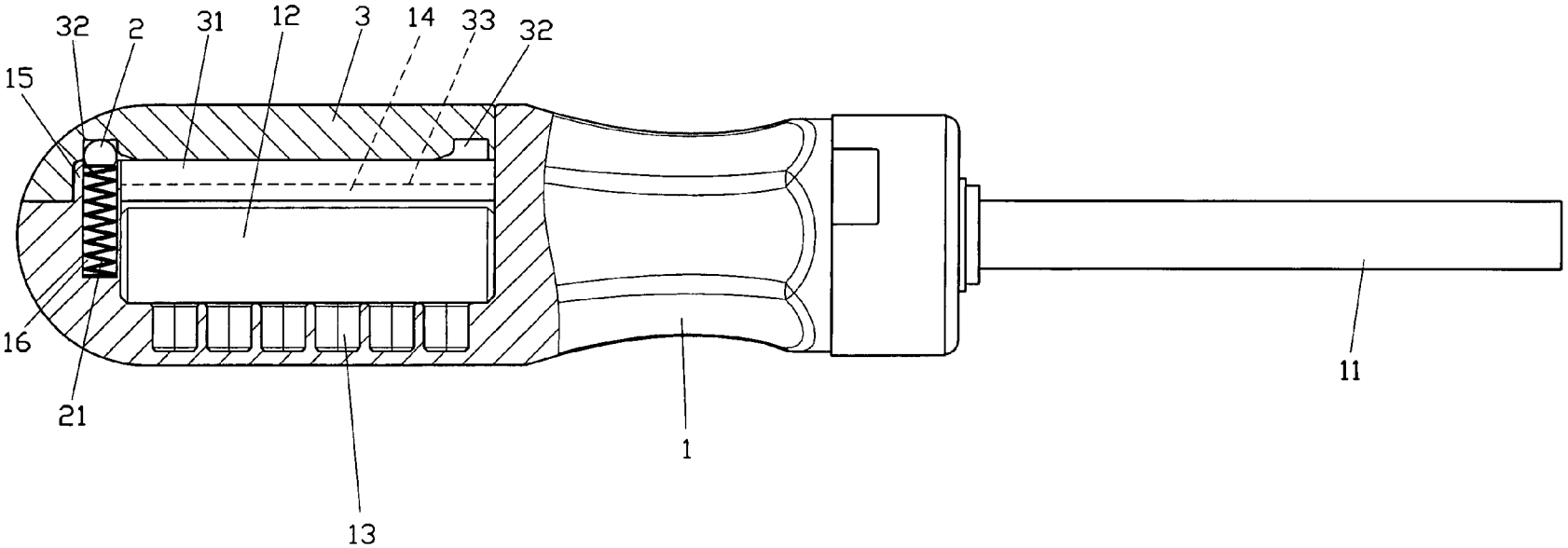
FIG. 2 is a side view of the present invention with partial sectioned.

To assemble the present invention, as shown in FIG. 2, the engaging device 2 with the elastic element 21 is placed into the trough 16 of the locator 15 of the handle 1. The sliding cover 3 is slid onto the handle 1 by means of aligning the two sliding channels 33 with the two sliding strips 14 of the handle 1 so the compartment 12 is covered by the sliding cover 3. The locator 15 of the handle 1 protrudes into the sliding trough 31. The engaging device 2 is located in one of the locating holes 32.

Figure 3:
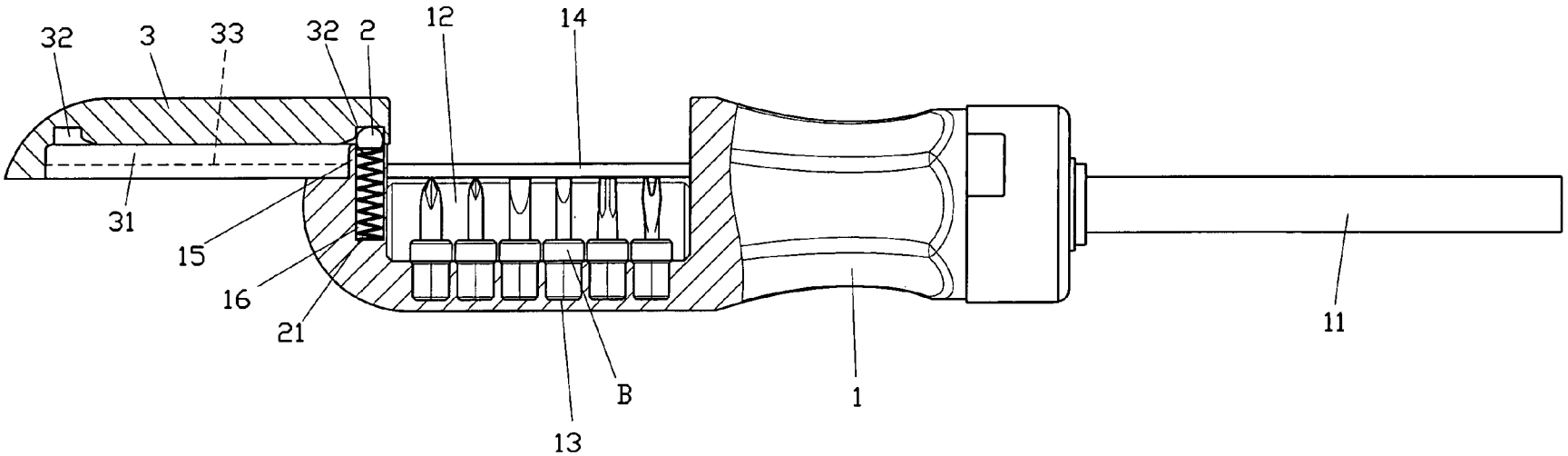
FIG. 3 is a view similar to FIG. 2 in an open status.
Figure 4:
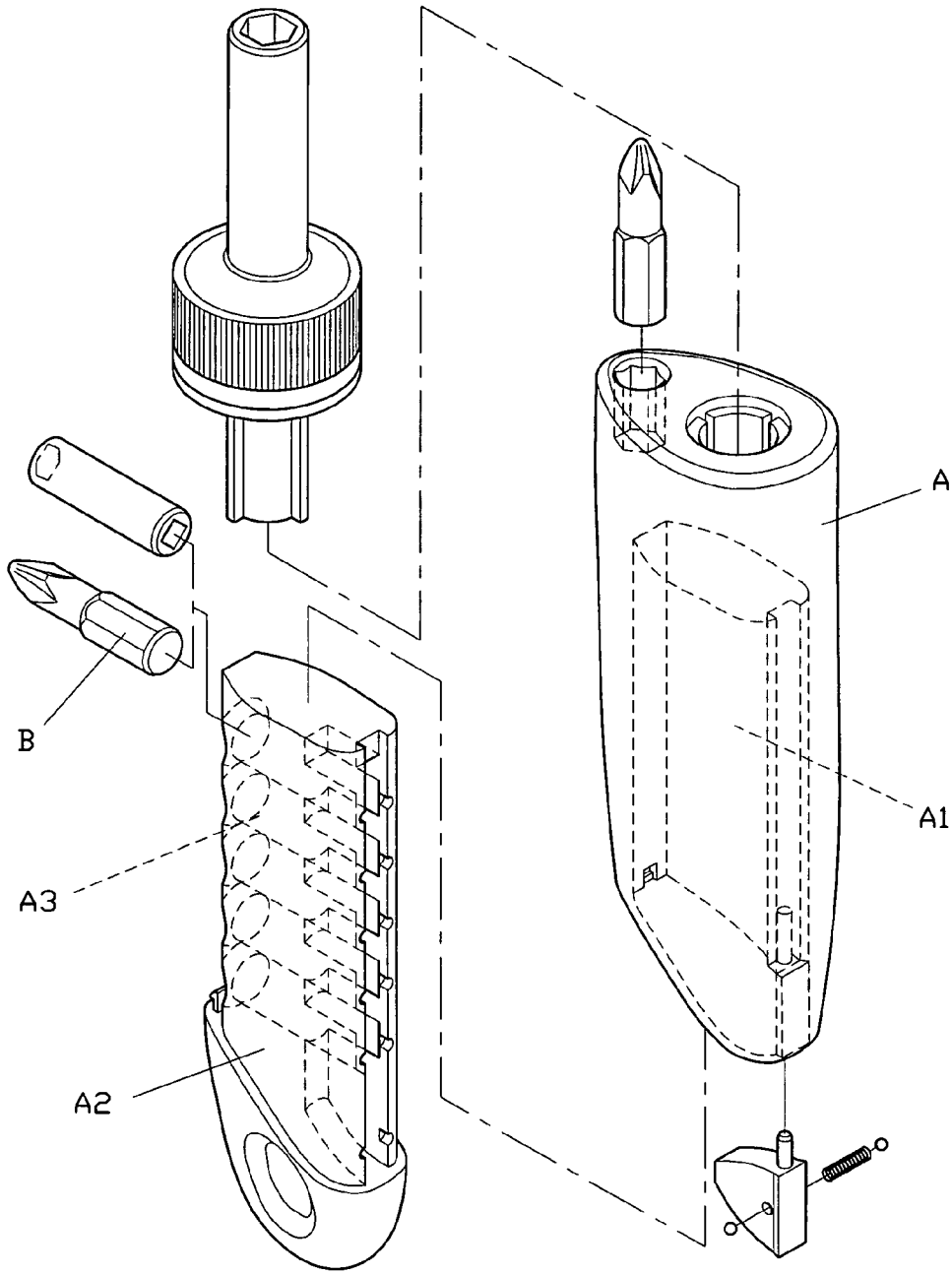
F I G . 4 (PRIOR ART)
FIG. 4 is an exploded view of a prior art.

To operate the present invention, as shown in FIG. 3, the sliding cover 3 is pushed outwardly with respect to the handle 1 with the sliding channels 33 sliding along the sliding strips 14. The engaging device 2 will be retreated from the locating hole 32 when the sliding cover 3 reaches to the endmost of the handle 1. The engaging device 2 will locate in the other locating hole 32, which secures the sliding cover 3 in place. Thus the user may pick up or put back screw heads into the compartment 12, and then the sliding cover 3 may be pushed back to its original position.

I claim:

1. A screwdriver handle structure comprising:

a handle including a compartment, a pair of sliding sections respectively disposed on opposing sides of said compartment, and a locator formed adjacent one end of said compartment, said locator having an opening formed therein;

an engaging device seated in said opening, said engaging device including a bead biased by an elastic element;

a sliding cover longitudinally slidingly displaceably engaged on said handle, said sliding cover having a sliding trough formed longitudinally therein, a pair of locating holes respectively formed at opposing longitudinal ends of said sliding trough for at least partially receiving said bead therein when a corresponding one of said locating holes is aligned with said engaging device, and a pair of sliding sections respectively disposed on opposing sides of said sliding trough for respective longitudinal sliding engagement with said sliding sections of said handle, wherein said bead functions as a detent to releasably engage a respective one of said locating holes to releasably hold said sliding cover in a respective open or closed position.

2. The screwdriver handle structure, as recited in claim 1, wherein said sliding sections of said handle are sliding strips, and said sliding sections of said sliding cover are sliding channels.

3. The screwdriver handle structure, as recited in claim 1, wherein said compartment has recesses formed therein to store screwdriver bits therein.

* * * * *